US011243018B2

(12) United States Patent
Youngstrom

(10) Patent No.: US 11,243,018 B2
(45) **Date of Patent: *Feb. 8, 2022**

(54) METHOD FOR CREATING ICE STRUCTURES

(71) Applicant: James Youngstrom, Rigby, ID (US)

(72) Inventor: James Youngstrom, Rigby, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/877,356

(22) Filed: May 18, 2020

(65) Prior Publication Data

US 2020/0386464 A1 Dec. 10, 2020

Related U.S. Application Data

(63) Continuation of application No. 16/667,482, filed on Oct. 29, 2019, now Pat. No. 10,663,204.

(60) Provisional application No. 62/753,813, filed on Oct. 31, 2018.

(51) Int. Cl.

| | |
|---|---|
| ***F25C 1/04*** | (2018.01) |
| ***F25C 5/14*** | (2006.01) |
| ***F25C 1/22*** | (2018.01) |
| ***F25C 5/00*** | (2018.01) |
| ***B28B 1/00*** | (2006.01) |

(52) U.S. Cl.

CPC ..... *F25C 5/14* (2013.01); *B28B 1/007* (2013.01); *F25C 1/04* (2013.01); *F25C 1/22* (2013.01); *F25C 5/00* (2013.01); *F25C 2300/00* (2013.01); *F25C 2303/00* (2013.01)

(58) Field of Classification Search

USPC ..... 52/233

See application file for complete search history.

(56) References Cited

U.S. PATENT DOCUMENTS

| | | | |
|---|---|---|---|
| 932,329 | A | 8/1909 | Rogers |
| 1,505,218 | A | 8/1924 | Sartore |
| 1,742,122 | A | 12/1929 | Bentley |
| 1,873,286 | A | 8/1932 | Chase |
| 1,907,502 | A | 5/1933 | Chilton |
| 1,952,729 | A | 3/1935 | Rawlings |
| 2,023,923 | A | 12/1935 | Harbordt |
| 2,113,359 | A | 4/1938 | Stebbins |
| 2,129,832 | A | 9/1938 | Eckrich et al. |
| 2,133,521 | A | 10/1938 | Wussow |
| 2,166,560 | A | 7/1939 | Schmelzer |
| RE21,249 | E | 10/1939 | Uline |
| 2,220,018 | A | 10/1940 | McKenna |
| 2,225,694 | A | 12/1940 | Freeman |
| 2,243,363 | A | 5/1941 | Thomas |

(Continued)

FOREIGN PATENT DOCUMENTS

| | | |
|---|---|---|
| GB | 2386844 | 10/2003 |
| WO | WO202081037 | 2/2003 |

OTHER PUBLICATIONS 8 page PDF title "Constructing Ice Structures" From Finding Lab. (Year: 2017).*

(Continued)

*Primary Examiner* — Robert Canfield
(74) *Attorney, Agent, or Firm* — Bateman IP

(57) ABSTRACT

A method for building an ice structure includes making a plurality of ice logs and attaching the ice logs together to form a support structure. The support structure may be two or more stories high and may be constructed by freezing the ice logs together.

21 Claims, 14 Drawing Sheets

(56) References Cited

U.S. PATENT DOCUMENTS

| | | | | |
|---|---|---|---|---|
| 2,536,217 | A | 1/1951 | Pownall | |
| 2,704,928 | A | 3/1955 | Curry | |
| 2,741,103 | A | 4/1956 | Cummins | |
| 2,768,507 | A | 10/1956 | Hoen | |
| 3,095,308 | A | 6/1963 | Rumsey, Jr. | |
| 3,274,794 | A | 9/1966 | Wilbushewich | |
| 3,396,545 | A | 8/1968 | Lamberton | |
| 3,565,389 | A | 2/1971 | Price | |
| 3,595,086 | A | 7/1971 | Bonnet | |
| 3,643,440 | A | 2/1972 | Knisse | |
| 3,750,412 | A | 8/1973 | Fitch et al. | |
| 3,831,769 | A | 8/1974 | Frank | |
| 3,957,098 | A | 5/1976 | Hepworth | |
| 4,099,946 | A | 7/1978 | Alexander | |
| 4,206,899 | A | 6/1980 | Whitehead | |
| 4,217,762 | A | 8/1980 | Sakamoto | |
| 4,223,043 | A | 9/1980 | Johnson | |
| 4,247,005 | A | 1/1981 | Buxton | |
| 4,326,822 | A | 4/1982 | Oshima | |
| 4,449,847 | A | 5/1984 | Scales | |
| 4,602,489 | A | 7/1986 | Hara | |
| 4,813,646 | A | 3/1989 | Fujio | |
| 4,910,976 | A | 3/1990 | Drummond, III | |
| 5,158,395 | A | 10/1992 | Holmberg | |
| 5,324,483 | A | 6/1994 | Cody | |
| 5,476,673 | A | 12/1995 | Sombrio | |
| 5,520,010 | A | 5/1996 | Altman | |
| 5,714,127 | A | 2/1998 | DeWitt | |
| 5,971,352 | A * | 10/1999 | Kirks | F25C 1/243 249/117 |
| 6,209,849 | B1 | 4/2001 | Dickmeyer | |
| 6,345,802 | B2 * | 2/2002 | Moore | F25C 1/22 249/117 |
| 6,508,075 | B1 | 1/2003 | Shipley | |
| D492,600 | S * | 7/2004 | Moore | D9/503 |
| 8,511,042 | B2 | 8/2013 | Christensen | |
| 9,776,188 | B1 | 10/2017 | Kamees | |
| 10,422,546 | B2 | 9/2019 | Christensen | |
| 10,422,564 | B2 | 9/2019 | Christensen | |
| 2001/0007345 | A1 | 7/2001 | Moore | |
| 2001/0025495 | A1 | 10/2001 | Newman | |
| 2003/0034317 | A1 | 2/2003 | Lafond | |
| 2004/0075038 | A1 | 4/2004 | Hang | |
| 2005/0161414 | A1 | 7/2005 | Wescott, III | |
| 2006/0054720 | A1 | 3/2006 | Valiton | |
| 2006/0175527 | A1 | 8/2006 | Morgan | |
| 2007/0003369 | A1 | 1/2007 | Hanson | |
| 2007/0014693 | A1 | 1/2007 | Kantrowitz | |
| 2010/0251733 | A1 | 10/2010 | Kim | |
| 2011/0198345 | A1 | 8/2011 | Feilders | |
| 2012/0177446 | A1 * | 7/2012 | Christensen | F25C 1/00 405/217 |
| 2012/0277906 | A1 | 11/2012 | Fassberg | |
| 2013/0116597 | A1 | 5/2013 | Rudge | |
| 2014/0008249 | A1 | 1/2014 | Muller | |
| 2017/0043346 | A1 | 2/2017 | Welch | |
| 2017/0198957 | A1 | 7/2017 | Barrett | |
| 2017/0282185 | A1 | 10/2017 | Kamees | |
| 2018/0017303 | A1 | 1/2018 | Hsu | |
| 2018/0178219 | A1 | 6/2018 | Bazin | |
| 2018/0202699 | A1 | 7/2018 | Migishima | |
| 2018/0252454 | A1 * | 9/2018 | Christensen | F25C 1/08 |
| 2018/0257088 | A1 | 9/2018 | Ritter | |
| 2018/0283759 | A1 | 10/2018 | Bess | |
| 2018/0361388 | A1 | 12/2018 | Welch | |

OTHER PUBLICATIONS

Jeremy Hall, Photographs, Flikr, Jan. 12, 2009.
Jeremy Hall, Photographs, Flikr, Feb. 5, 2009.
Zermatt Resort, Dec. 18, 2009.
Alaskanalpineclub.org website showing ice towers constructed from 2003-2008, publicly available prior to Jan. 10, 2010.
Adirondack Daily Enterprise—The Origins of Saranac Lake's Winter Carnival—Village's Premiere Event Had Modest Beginnings. Publicly available Feb. 1997.
History of the Adirondacks—Castles of Ice—published at least as early as Apr. 4, 2001.
Ice Castle at Lake Louise, Banff, Albert Canada, made available to the public by Cosmic kdd99-—Flickr—Feb. 22, 2009.
The castles at Silverthorne—www.icecastles.com—Dec. 9, 2009.
Midway Ice Castles: Day One! First Week and Fun Facts—Brent Christensen's publicly available blog www.brentsicecastle.blogspot.com/2009/12/first-day-of-brents-ice-castle-at.html.—Dec. 8, 2009.
Jeanae Jeffries, Daily Herald, Resident Creates Own Ice Castle, Jan. 28, 2009.
Alex Cabrero, KSL.com, Ice Castles Turns Heads At Midway Resort—Dec. 25, 2009.
https://web.archive.org/web/20120113175220/http://www.icecastles.com/.
https://www.diynetwork.com/how-to/outdoors/patios-and-decks/how-to-build-custom-deck-railings (Exact Date unknown—believed to be 2015).
https://www.creativemechanisms.com/blog/all-about-polypropylene-pp-plastic—May 4, 2016.
https://www.creativemechanisms.com/blog/polyethylene-pe-for-prototypes-3d-printing-and-cnc—Sep. 14, 2015.
www.instructables.com/id/Easy-ice-sculpture-for-kids-of-all-ages/, Mar. 5, 2012.
Request for Inter Partes Review, U.S. Pat. No. 10,663,204.
Easy Ice Sculpture—for Kids of All Ages—Mar. 5, 2012.
Everything You Need to Know About Polypropylene—May 4, 2016.

* cited by examiner

METHOD FOR CREATING ICE STRUCTURES

BACKGROUND

State of the Art

The present invention relates to ice structures, and in particular to methods of forming ice structures to be covered in ice to make temporary structures, art or public attractions.

Field of Art

There are a variety of situations in which structures are made of snow or ice. For example, many cities have winter festivals which include contests for displays made from ice. In some locations, buildings are made of ice during the wintertime. Some northern countries even have hotels which are formed by ice or snow which have been carved or otherwise shaped to provide sleeping rooms, restaurants, etc.

One popular use for ice structures is as an entertainment destination. In many locations a structure is built and then sprayed with water so that the underlying structure is encased in ice. Usually the sprayed water is allowed to drip so as to form icicles hanging from the underlying structure. The structures, commonly referred to as ice castles or ice palaces, can be provided with colored backlighting so as to form pieces of art for viewing by the public. In some cases, the ice sculptures are so large that they can include tunnels and walkways where visitors can actually walk on/through the ice castle. As water continues to be sprayed, the structure grows, often to the height of 2 or more stories.

While some have used wood or steel structures as the initial starting points for applying the water, when lights are used the generally opaque wood or steel is visible through the ice and makes the ice castle appear less natural. One solution to this problem is disclosed in U.S. Pat. No. 8,511,042 ("the '042 patent"). The '042 patent shows a method of constructing structures in which a table is used with running water to create a number of icicles extending downwardly from the table. Once the icicles have reached a desired size they are broken off and attached to one another by the use of slush or an ice/water mixture. These icicles are used as a framework which is over sprayed with water to form the ice structure.

One concern with the methodology used in the '042 patent is that icicles are somewhat unpredictable in their formation and may be substantially broader on one end than the other. Icicles also may have inconsistent thickness and density along their length. Another concern is that a substantial amount of water may be used simply forming the icicles used to form the initial structure.

Thus, there is a need for a method for constructing ice structures which is relatively easy to use and provides improved predictability.

SUMMARY OF THE INVENTION

A method for creating ice structures may include the formation of a plurality of ice logs. The ice logs may then be joined together to build a desired ice structure.

In accordance with one aspect of the invention, the ice logs are formed by filling elongate sleeves with water and allowing the water to freeze. The elongate sleeves are then removed from the ice log formed by the frozen water and the ice logs are used to construct the desired ice structure, or a frame upon which a desired ice structure is formed.

In accordance with another aspect of the invention, the elongate sleeves may be formed from a thin, disposable plastic, polyurethane or other material. The material can then be filled with water and may be bent or otherwise disposed in a desired shape to form an ice log having the desired characteristics.

In accordance with another aspect of the invention, once water in the elongate sleeves has frozen, a saw may be used to cut ice logs of the desired size. Thus, for example, an initial ice log may be formed which is 6 inches in diameter and 60 feet long. A chainsaw can then be used to cut the ice log into five 8-foot segments and two 10-foot segments.

In accordance with another aspect of the invention, the ice logs can be connected to form a structure which has 2 or more stories and preplanned pathways, balconies, etc., along which visitors can walk.

BRIEF DESCRIPTION OF THE DRAWINGS

Various embodiments of the present disclosure are shown and described in reference to the numbered drawings wherein.

Figure 1:
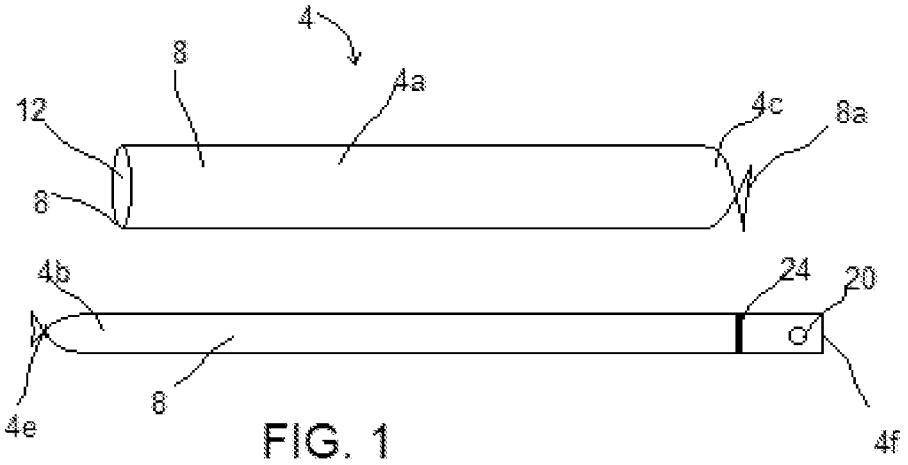
FIG. 1 illustrates a pair of sleeves having water contained therein for making ice logs.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "generally" refers to something that has characteristics of a quality without being exactly that quality. For example, a structure said to be generally vertical would be at least as vertical as horizontal, i.e. would extend 45 degrees or greater from horizontal. Likewise, something said to be generally circular may be rounded like an oval but need not have a consistent diameter in every direction.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Turning now to FIG. 1, there is shown a side view of two ice logs 4 formed in accordance with principles of the present invention. The ice logs 4 may be formed by filling a sleeve 8 with water and leaving the filled sleeve at a location which is below 32° F. or 0° C. Over time, the water will turn to ice which can then be used for forming structures.

In accordance with one aspect of the present invention, the sleeve 8 can be formed from a thin, flexible material such as many plastics, such as polyethylene. The material can also be see-through so that the user can ensure that there are no large bubbles trapped inside the sleeve. Typically, the flexible sleeve will be tied or clamped off at one end, filled to the desired length and then the opposing end tied off or clamped.

As shown on ice log 4*a*, the end 8*a* of the sleeve may simply be tied off by knotting the end of the sleeve 8 to form end 4*c* of the ice log. In the alternative, a tie or clamp could be used to close the end as shown at end 4*e* on ice log 4*b*. The use of a thin, flexible material may allow the person making an ice structure to cut the ice log 4*a* to a desired length by the use of a saw, etc. as shown at end 4*d* on ice log 4*a* (thereby exposing the frozen water 12). The sleeve 8 can then be stripped off the ice log 4 and the ice log used as needed.

According to one configuration, the person making the ice structure may be able to plan needed lengths and to know the dimensions of the piece beforehand. Culturing icicles, even by the use of a table, can be somewhat unpredictable as temperature, wind and flow patterns result in a variety of different shapes. Water has to be added at a flow rate which is fast enough that the water does not freeze before forming the icicle, but not so fast that the water flows over and melts an existing icicle. A strong breeze can cause the icicles to form at an angle, and/or can disrupt the flow of water to the growing icicle. A warm breeze can melt back the icicles, requiring that they be given additional time to grow to a desired length. Very strong winds can cause icicles to break off the structure from which they hang.

In contrast, with the present disclosure the person making the structure may know that they will need 50 ice logs which are 10 feet long each. The person can then fill five 100-foot sleeves 8 having the desired diameter with water and leave them out to freeze overnight or for a couple of days depending on the temperature. As soon as the water is properly frozen a chainsaw can be used to quickly form 50 ice logs of the same length so that building may commence.

According to another configuration, the ice logs can also be formed in an industrial freezer if necessary and can be stacked on shelves to maximize the number of logs created in a small space. Because the water is contained within the sleeves 8, the floor of the freezer will not be slippery, and the structural components of the ice structure can be pre-made. As soon as the ambient temperature falls to a desired threshold, the ice logs 4 can be assembled into the ice structure and, if desired, sprayed with water to cover the ice structure in icicles. This may substantially speed up the process for forming the ice structures (such as ice castles), thereby allowing an attraction to be open earlier and generate larger revenues.

Another advantage of forming the ice logs in plastic sleeves is that ice has a tendency to freeze to other pieces of ice. If a number of pieces of ice are stacked on top of one another, it is not uncommon for the pieces to freeze together, thereby requiring pieces of ice to be broken off the other pieces of ice when it is needed for use. The plastic sleeves, however, tend to prevent the ice logs from freezing to each other. Thus, a large number of ice logs can be placed on top of one another (either for shipping or simply for convenience during use) with the plastic sleeves left in place so that ice logs do not freeze together. One needed, the log can be moved into place and the plastic sleeve cut with a razor blade, etc., to remove it from the ice log immediately before use.

According to another configuration, the various load capacities of the structure can be calculated more readily. Because the ice logs will be substantially solid ice, the amount of weight which can be carried by an individual log over a given span can be more readily calculated than using a structure which forms more randomly and which is inconsistent from end to end, such as an icicle. For example, on lake ice, 3 inches of ice will support a person on foot, 4 inches will support a group in single file, while 7½ inches will support a passenger car. In the present invention a balcony could be formed by placing a number of 4-inch diameter ice logs adjacent one another and then running a sprinkler over the logs to create another inch or two of ice. While large diameter ice logs can be used for building structural support, smaller diameter ice logs can be used for providing a frame to grow icicles and for connecting large diameter ice logs for lateral support.

In some applications, such as where a specific three-dimensional shape is desired, the sleeve 8 could be formed from a more rigid plastic, such as polyvinyl chloride. In such configurations the sleeve 8 may include a port 20 (shown on sleeve 4*b* of FIG. 1) and retainers 24 for holding opposing sides of the sleeve together while the water freezes into an ice log. The sleeve 8 may also be squared off as shown at end 4F of ice log 4*b*.

A rigid sleeve could be made in a variety of shapes. For example, the sleeve may form a void which is generally helical in shape. The two halves of the sleeve could be held together with the retainer(s) 24 and filled with water. Once the water is frozen the two halves of the sleeve can be removed thereby leaving a helically shaped ice log which can be used as a design element.

It will be appreciated that a variety of different dimensions of ice logs may be used. For example, a large balcony may be supported by ice logs having a 6-inch or 8-inch diameter. In contrast ice logs could be made having a 2- or 3-inch diameter when being used as an initial structure for growing icicles and the like as part of design elements which have relatively minor loadbearing requirements.

The ice logs 4 may be preferred in some applications over wood or steel frames. When an "ice castle" is illuminated, a steel or wood frame may be visible, at least in shadow, and may lessen the aesthetic desirability of the ice castle. In contrast, ice logs are typically translucent and, in many cases, transparent thereby allowing light to more readily flow through the design, improving the design's aesthetics. In fact, icicles can entrain air as they are being formed, leaving the icicle with a cloudy appearance which partially obscures light. In contrast, as the water being used to form an ice log sits air bubbles tend to pass out of the water, often leaving the ice logs more translucent than many icicles. This can be advantageous for lighted ice structures.

Figure 2:
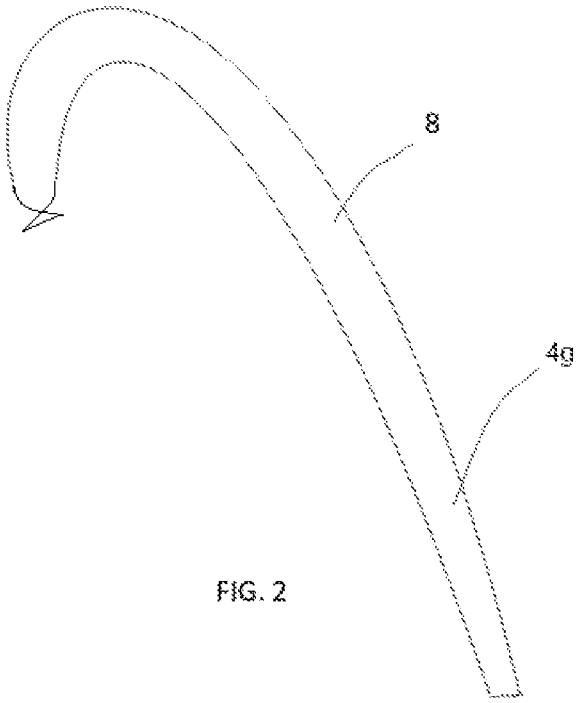
FIG. 2 illustrates a sleeve having water contained therein for making an ice log in the shape of a candy cane.

Turning now to FIG. 2, there is shown an ice log 4*g* disposed in a liner 8 in the shape of a candy cane. The sleeve or liner 8 may be rigid, such as two rigid pieces being held together to hold the water as it freezes, or the liner may be flexible and simply moved into the desired shape once it has been filled with water and the ends tied off. Unlike the use of icicles, etc., the use of the liner or sleeve 8 allows for a wide variety of shapes to be formed which may be used in the aesthetics of the ice structure being made. For example, if the ice structure is meant to replicate Santa's workshop, two candy cane-shaped ice logs could be disposed on either side of the door into the ice structure. While the candy cane-shaped ice log 4*g* could be subjected to sprinklers spraying water so as to generate icicles, the ice log itself may be used as an aesthetic feature of the overall design of the ice structure. The use of a flexible sleeve 8 is highly advantageous because the shapes into which the ice logs are formed are up to the creativity of the creator. Additionally, a flexible sleeve which can be cut away is advantageous because it is easy to remove the ice log from the sleeve regardless of its shape. All the creator needs to do is run a razor blade down the sleeve and pull the sleeve off the ice log.

Figure 3:
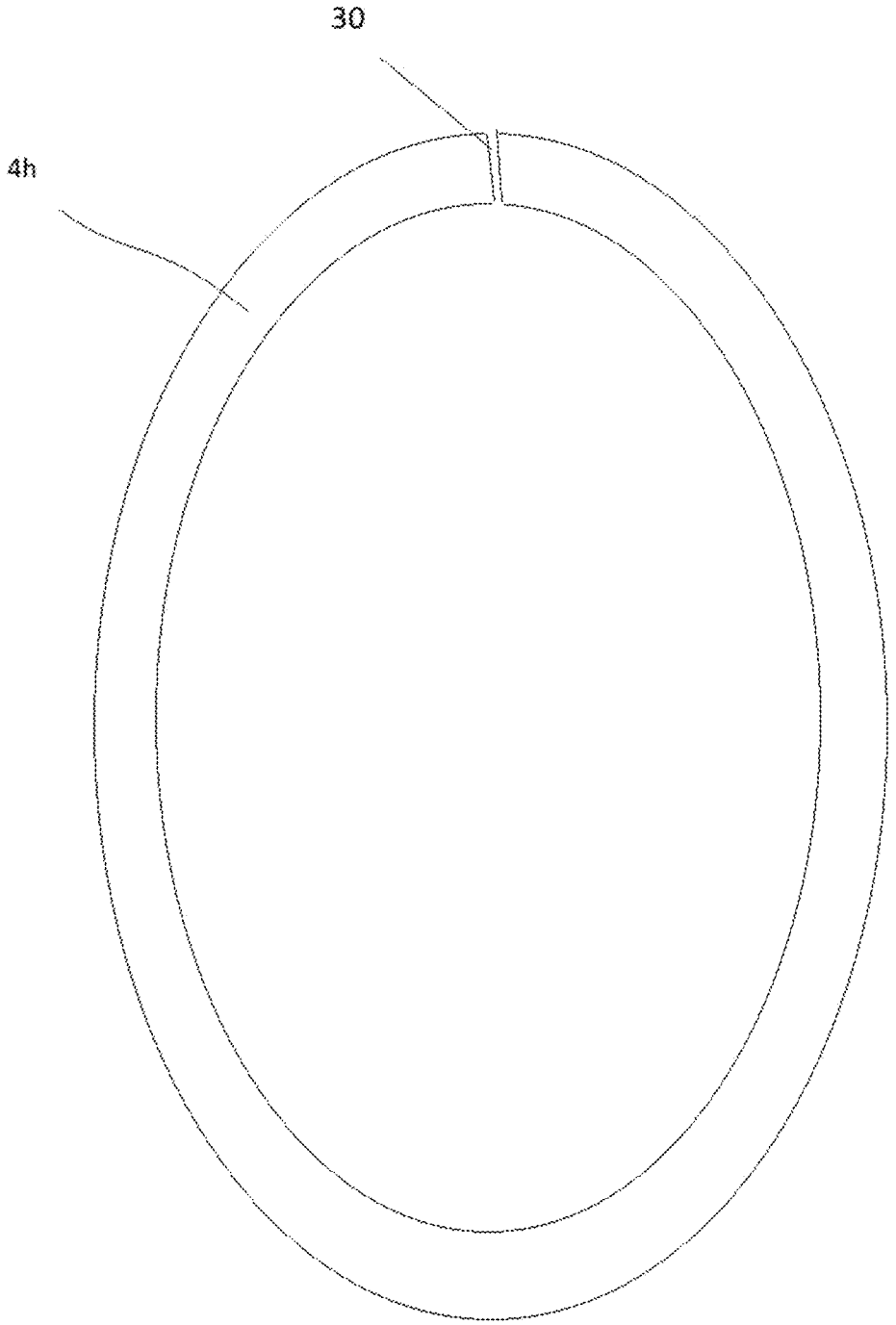
FIG. 3 illustrates an ice log formed in an oval shape as could be used to form an oval-shaped room.

FIG. 3 shows an ice log 4*h* formed in an oval shape. The oval-shaped ice log 4*h* could be used to form an oval-shaped room, either by being placed adjacent the bottom of a number of ice logs extending vertically so as to anchor the ice logs in a desired pattern, or by resting on top of the vertical ice logs so as to create a continuous header around the room. Once the oval-shaped ice log 4*h* is in place, the small opening 30 could be closed by filling the same with snow or slush and applying water. Of course, a number of ice logs 4*h* could be placed front-to-front so as to form a tunnel by simply applying a small amount of water to freeze the ice logs together. One advantage of this method of building an ice structure is that the person making the ice structure can form a footer and header for a wall in any desired shape. Instead of having to individually connect dozens of small icicles to form a wall, a single footer can be placed on the ground, vertically extending ice logs anchored thereto, and then a header placed along the tops of the vertically extending logs. Thus, for example, a wall 20 feet long and 10 feet high could be built with as few as 6-8 pieces of ice. The wall could provide a smooth curvature or other shape. In contrast, building such a wall from icicles may require dozens of icicles and multiple layers.

Figure 4:
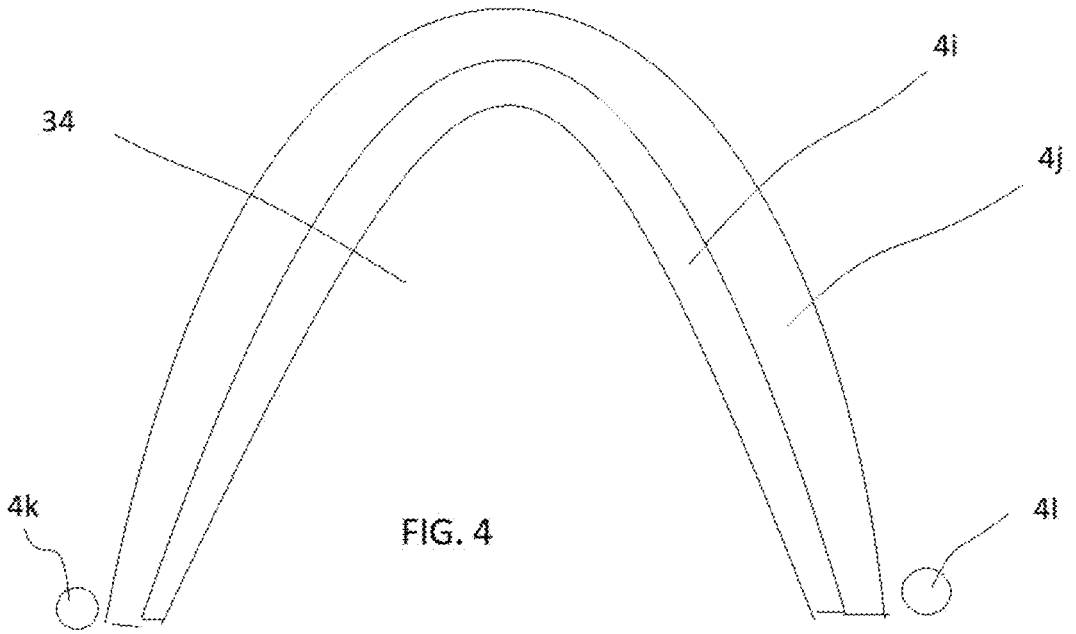
FIG. 4 illustrates an end view of a pair of arcuate ice logs forming a tunnel and a pair of ice logs being used to anchor the arcuate ice logs.

FIG. 4 illustrates an end view of a pair of arcuate ice logs 4*i* and 4*j* forming a tunnel 34 and a pair of ice logs 4*k* and 4*l* being used to anchor the arcuate ice logs. Using the ice logs as anchors is relatively easy. The anchor ice logs 4*k* and 4*l* are simply placed adjacent to the base of the more vertically extending ice logs 4*i* and 4*j* and snow or water is applied so that the ice logs freeze together. Vertically extending ice logs can also simply be disposed in place and have snow packed around their base. Because the ice logs can be cut or formed with a flat bottom, they are much easier to dispose in a vertical orientation than is an icicle. They can also be used as a footer over a length much longer than most icicles and are substantially consistent in dimension—thereby making it easier to anchor vertical ice logs into the footer than attaching icicles together would typically allow.

Figure 5:
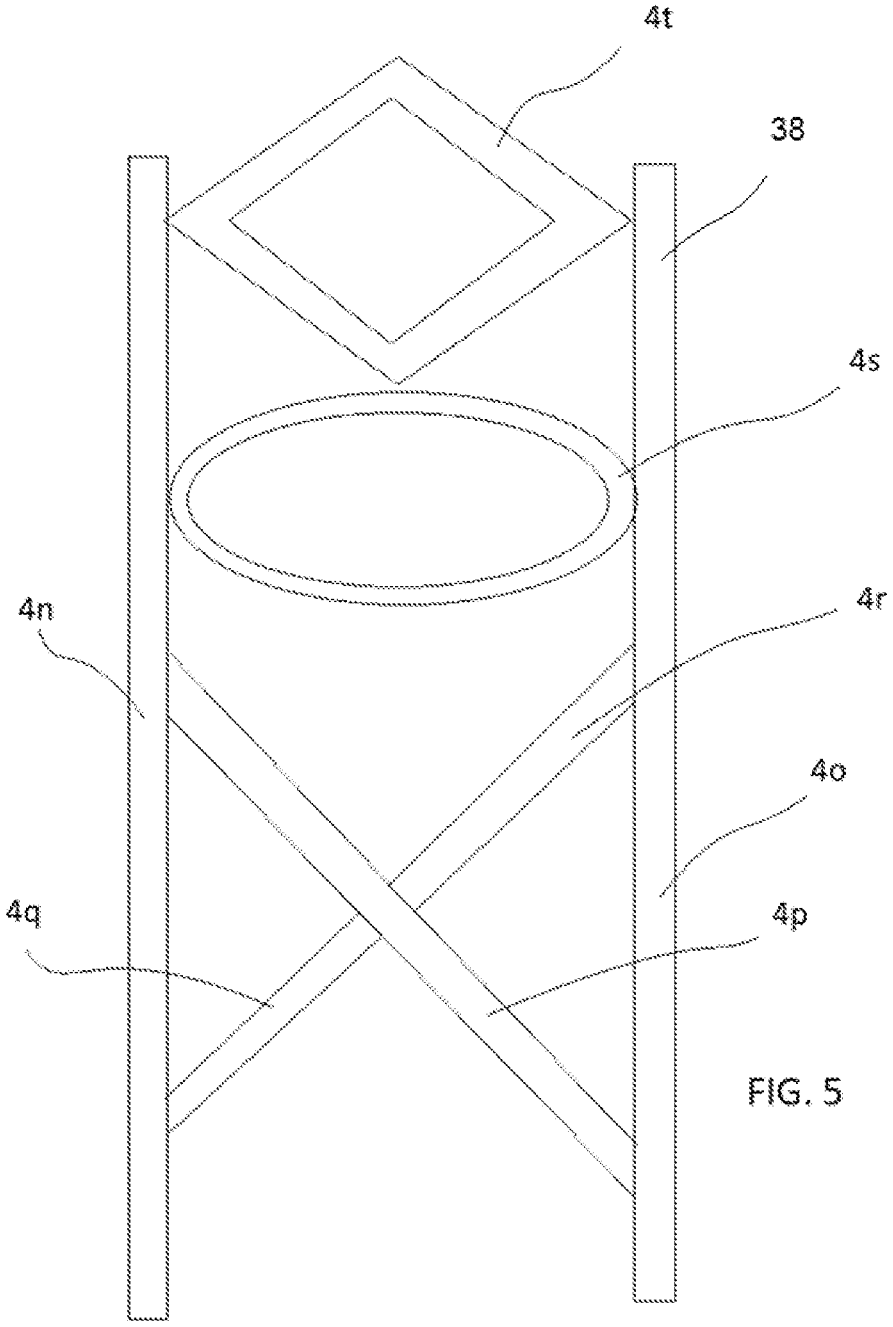
FIG. 5 shows a support structure formed out of ice logs making different shapes upon which icicles can be formed to produce a work of art or part of an ice castle.

FIG. 5 shows a support structure 38 formed out of ice logs making different shapes upon which icicles can be formed to produce a work of art or part of an ice castle. The structure 38 is formed by a first ice log 4*n* and a second ice log 4*o*. Extending between ice logs 4*n* and 4*o* is a third ice log 4*p* and two short ice logs 4*q* and 4*r* which are attached to one another so as to form an "X." The X shape can be used both aesthetically and structurally on the structure such as a design element or as a support frame for growing icicles. Disposed above the X shape is a generally oval-shaped ice log 4*s* and a diamond-shaped ice log 4*t*. The various ice logs can be attached to one another by the use of snow, slush or spraying with water until the structures freeze together. The design can be formed by bending the flexible sleeve (not shown in FIG. 5) into the desired shape. Once the water has frozen into ice and the sleeve removed, the small gap left can be filled with ice or snow.

Figure 6:
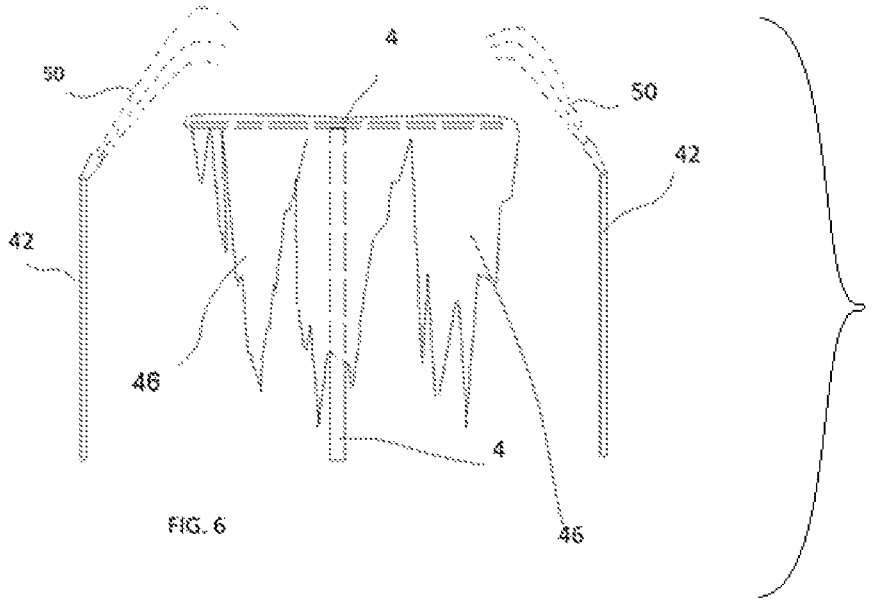
FIG. 6 shows a pair of ice logs being subjected to sprinklers or another water sprinkling device so as to form icicles on the ice logs.

FIG. 6 shows a pair of ice logs 4 being subjected to sprinklers 42 or another water spraying device so as to form icicles 46. As the water 50 contacts the ice logs 4, the water freezes and gradually builds upon itself to create random icicles. It will be appreciated in accordance with the present invention that the ice logs 4 could be used to form a structure in which all of the visible ice is icicles 46, or a structure which includes no icicles and is simply formed from ice logs. Most commonly, the ice logs are used to allow the builder to create walkways and other structures which enhance the user experience by allowing the user to come close to a greater part of the overall structure. Either way, the ice castle or a structure can be enhanced by lighting the structure, particularly at night, as the ice logs 4 provide minimal interference with light flow. Additional ice logs 4 can be added on top of the icicles 46 or other ice logs to further increase the size of the ice castle on display.

Figure 7:
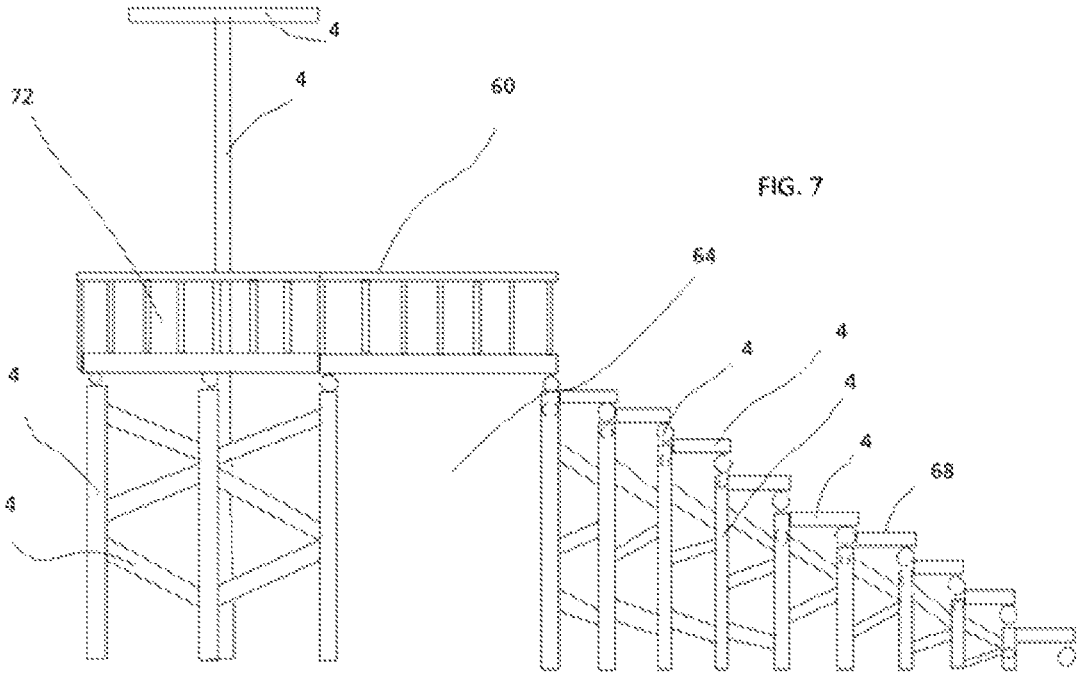
FIG. 7 illustrates an ice structure built from ice logs having a tunnel and a set of stairs leading to a second story balcony.

Turning now to FIG. 7 there is shown an ice structure 60 built from ice logs 4 (only some of which are marked) having a tunnel 64 and a set of stairs 68 leading to a second story balcony 72. Some of the ice logs 4 are disposed generally vertically so as to form support pillars, while other support logs are disposed generally horizontally to form steps, beams connecting the support pillars and supporting the ice logs forming the balcony 72. Still other ice logs can be disposed at angles between vertical and horizontal. These intervening ice logs may be used for structural support and/or as a support frame for growing icicles if all or part of the ice structure 60 is sprayed with water.

It will be appreciated that the use of the ice logs in accordance with the principles of the present invention allows substantial creativity on the part of the builder of the ice structure. The sleeves 8 can be used to make a wide variety of shapes in the ice logs, thereby allowing for a wide variety of designs. For example, stairways can be curved. A number of wavy ice logs could be frozen together to form a wavy slide down from a balcony. Walls formed from nothing but ice logs could be used, or the ice logs can be covered with icicles by spraying water over the ice logs. Tunnels of various shapes and sizes can be formed. Additionally, the ice logs can be formed in such a way that electrical cables or lighting could be disposed within the ice logs thereby ensuring that they would not present a tripping hazard to patrons of an ice castle display. (An image of such ice logs in shown in FIG. 13)

Figure 8:
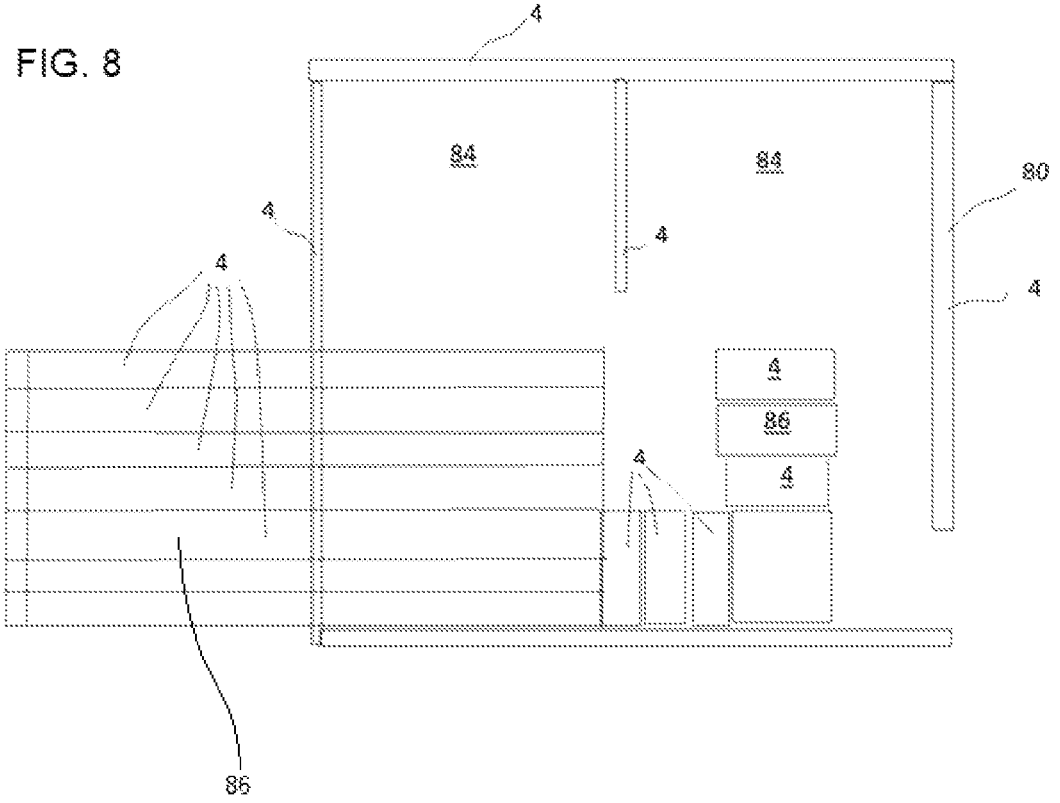
FIG. 8 shows a top view of a house having a second story with a balcony formed in accordance with principles of the present invention.

FIG. 8 shows a top view of a house 80 having a number of rooms 84 and a second story with a balcony 86 formed in accordance with principles of the present invention. It will be appreciated that the entire house could be built out of ice logs. The ice logs could be either translucent or nearly transparent to thereby conduct light through the house. If multiple different lights are used, the house could be designed to change colors as the attendees walked through the house. If desired, the house could even be structured so as to accommodate sleeping arrangements, thereby allowing the "ice house" to function as a hotel. Likewise, a restaurant could be made where the structure is nearly completely made of ice.

Figure 9:
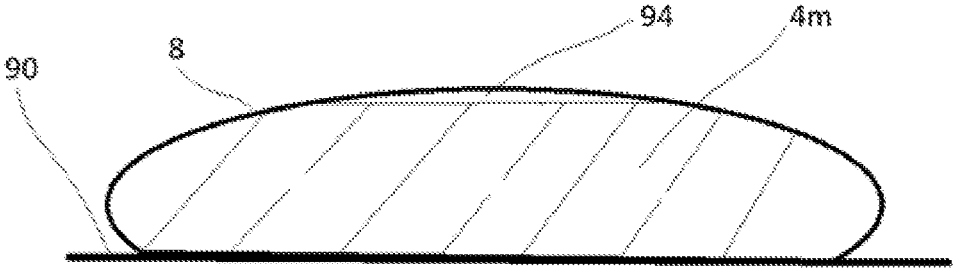
FIG. 9 shows a cross-sectional view of a sleeve partially filled with water to form a base.

FIG. 9 shows a cross-sectional view of an ice log 4*m* which is used to form a base or footing. The ice log 4*m* is formed by taking a sleeve 8 and filling it partially with water so as to form a flattened ice log. The ice log 4*m* can be made at a remote location. However, there are advantages to forming the ice log 4*m* at a location in which it will serve as a base for building an ice castle/palace. The bottom of the ice log is flattened due to the partial filling of the sleeve 8. When formed in place the bottom of the ice log conforms to the ground 90 on which the ice log is formed. Thus, if the ground is uneven or sloped the ice log 4*m* will be properly positioned in place. By allowing some air into the sleeve 8 an air pocket 94 can be left. This results in a base which has a flat top surface. If desired, this flat surface can be used to build structures or otherwise receive other ice logs. It will be appreciated that ice logs can be made with flattened surfaces which facilitate building a variety of different designs.

Figure 10:
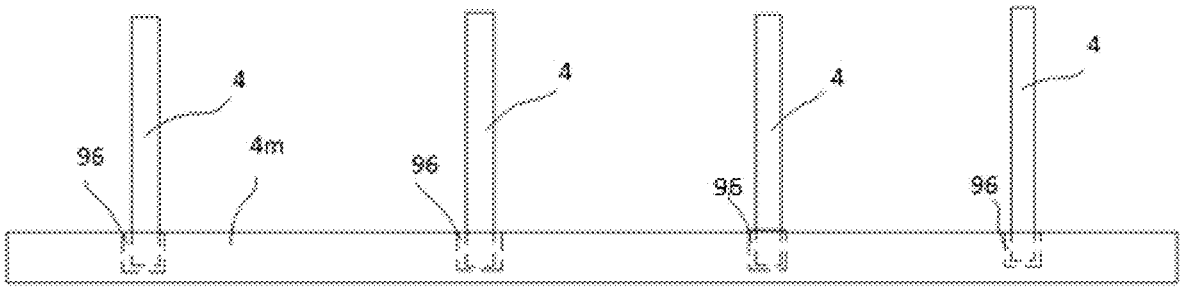
FIG. 10 shows a side view of a base having a plurality of ice logs inserted vertically to support the ice logs.

Once the ice log 4*m* has frozen, the sleeve 8 may be cut away. The portion of the sleeve between the ice log 4*m* and the ground 90 may be left in place or may be slid out as desired. The base formed by the ice log 4*m* is highly desirable as it facilitates the rapid building of ice structures. As shown in FIG. 10, the base formed by ice log 4*m* can have one or more pockets or holes 96 cut in. This can be accomplished with an auger or a chainsaw. The pockets or holes 96 may extend partially into or all the way through the ice log 4*m*. Other ice logs 4 may be inserted into the holes and slush and/or water can be poured into the holes 96 to freeze and thereby anchor the other ice logs into ice log 4*m*. If the holes are formed only slightly larger than the cross-sectional area of the other ice logs 4, the side wall defining the holes can be used to hold the other ice logs in vertical or other orientations even while the slush on or water poured and the holes freezes. This is highly advantageous as it allows an ice structure to be built in a relatively short amount of time.

While shown laying on the ground, it will be appreciated that ice log 4*m* or even a more cylindrical ice log can have holes drilled in to allow the insertion of other ice logs for the building of intricate structures. For example, an ice ladder could be formed in such a way that the rungs of the ladder formed by ice logs are securely held within larger ice logs on either side.

Figure 11:
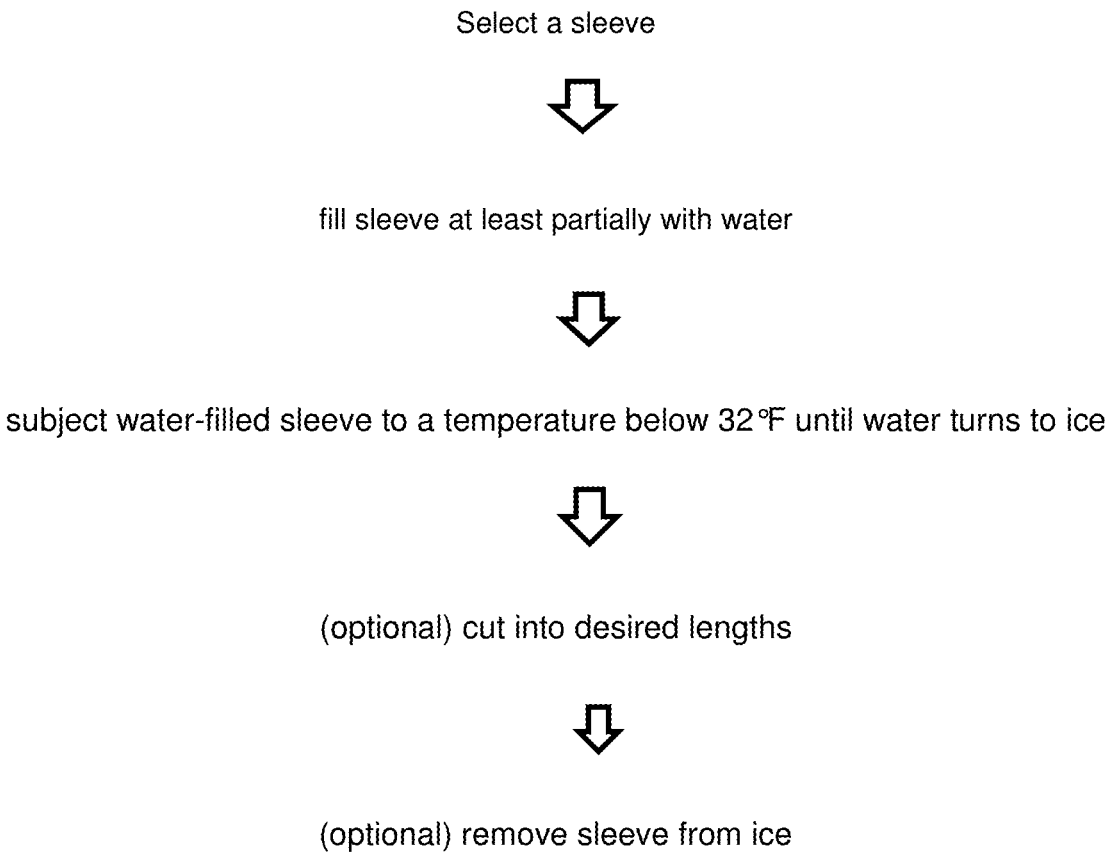
FIG. 11 shows a flowchart for forming ice logs in accordance with principles of the present invention.

FIG. 11 shows a flowchart for forming ice logs in accordance with principles of the present invention. The first step is to select a sleeve. The sleeve may then be filled with water. The water filled sleeve is then subjected to a temperature below freezing (i.e., below 32° F. or 0° C.). Once the water has frozen, the sleeve is removed from the frozen water which forms an ice log for building an ice structure. While the sleeve could be warmed to help slide the sleeve off the ice log, this is a time-consuming process and releases a wet ice log which must be handled carefully so that the builder's hands do not freeze to the log. In contrast, the flexible sleeves in accordance with the present invention prevent the logs from freezing together and can be quickly removed without needing to apply heat to unfreeze the outer surface of the ice log.

Figure 12:
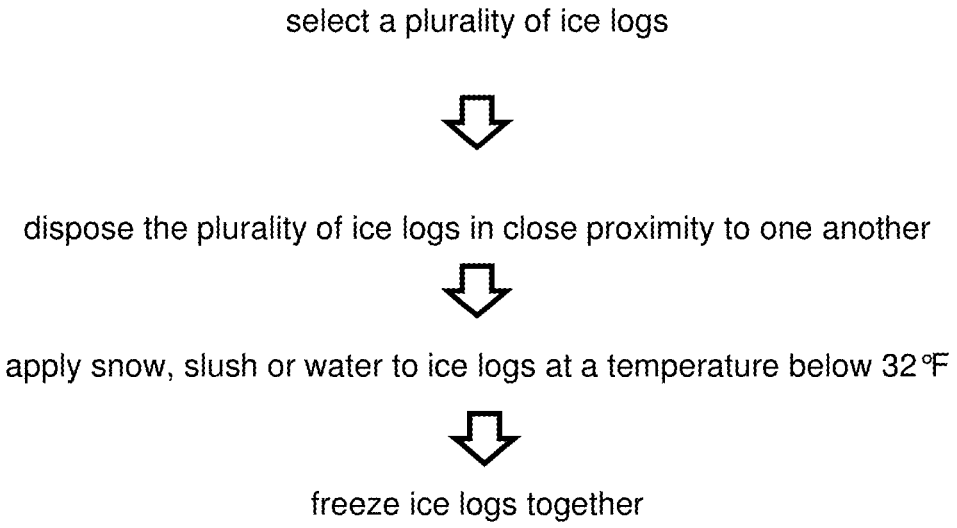
FIG. 12 shows a flowchart for building an ice structure in accordance with principles of the present invention.

FIG. 12 shows a flowchart for building an ice structure in accordance with principles of the present invention. The first step is to select a plurality of ice logs. The ice logs are placed in close proximity and snow, slush, or water is applied to the ice logs at a temperature below 0° C. or 32° F. so as to connect the ice logs by ice. In building the ice structure, a plurality of the ice logs will be disposed generally vertically, and a plurality of ice logs will be disposed generally horizontally and attached to the generally vertically ice logs with snow, slush, or water and allow them to freeze. The method may include disposing a plurality of ice logs so as to form the floor of a second story of the ice structure, or as a second story balcony.

The method may further include spraying the ice logs so as to develop icicles on the ice logs. The method may further include adding additional ice logs to the initial ice logs and/or icicles in order to increase the size of the structure.

As has been partially discussed above, the use of flexible sleeves to form ice logs has numerous advantages. The ice logs may be clearer and stronger than conventional icicles, as the water freezes into a log having a substantially consistent diameter and are not reliant on dripping water to form. The ice logs can be grown much larger in a shorter amount of time, and the creator has much greater control over the end product. For example, one company making ice structures from icicles claims that it places more than 1000 icicles a day to build its structures. Those icicles would typically be a variety of shapes and sizes. In contrast, in the present invention the person forming the ice logs can accurately produce a given length of ice logs of diameter a, and another given length of diameter b, and still yet another length of diameter b as required.

Rather than using thousands of icicles which are 2-3 feet long and tapering from one end to another, the present system allows large structures to be built using large ice logs. For example, a center log for a large attraction could be desired at 9 inches in diameter and 15 feet tall. Creating such an icicle would be extremely difficult as the weight of the icicle may cause it to break off of the structure from which it depends long before the icicle reached such a length or girth. In contrast, such an ice log can be formed by simply selecting a 9-inch sleeve which is about 16 feet long, tying off one end of the sleeve, filling it with water and tying off the opposing end. The ice log can be made in a commercial freezer or left outside to freeze in ambient air. When needed, the sleeve may be simply cut off and the ice log used. (The sleeve could also be left on if desired). Prior to removal, the sleeve reduces the risk of ice logs freezing together, thereby facilitating transport and stacking at the location of the attraction.

Hundreds of ice logs of smaller diameters can be formed overnight if temperatures are sufficiently cold, or over a couple of days at warmer temperatures. For example, ten sleeves 100 feet long and four inches in diameter can be used to make 50 20-foot ice logs or 100 10-foot ice logs which are all substantially 4 inches in diameter. Thus, it is much easier to plan out an ice sculpture because the person making the ice logs knows exactly what he or she will get.

Less water is wasted as the sleeve keeps all of the water necessary to form the ice log within the sleeve, rather than dripping onto the ground, as only some of the water freezes to make an icicle. Likewise, the creator of the ice structure can mold the ice logs into desired shapes and can be easily removed from the sleeves when needed, but stored in the sleeves prior to use to prevent the ice logs sticking together. The sleeves also help prevent breaking if two ice logs get banged together.

Figure 13:
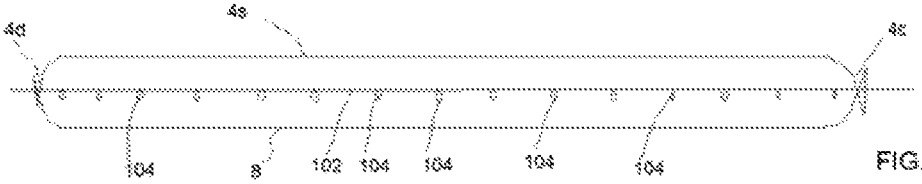
FIG. 13 shows a side view of an ice log being formed with lighting or power cables disposed therein.

Turning now to FIG. 13, there is shown an ice log 4*s* formed in accordance with another aspect of the invention. Instead of simply placing lighting or other powered lines behind various ice formations, the ice log 4*s* is formed by placing a powered line 102, such as a line having lights 104, in the sleeve 8. One end 4*d* I is tied off and the sleeve filled with water. The other end 4*c* is then tied off. The water in the sleeve 8 is then frozen and the sleeve removed. The resulting ice log 4*c* has a power line inside (which could be used to power various attractions and/or to light the ice log. It will be appreciated that lighting behind a structure tends to pass the same color of light through the adjacent structures. By having the lighting inside the log, however, individual logs could be provided with different color lights, or could change color in sequence.

Figure 14:
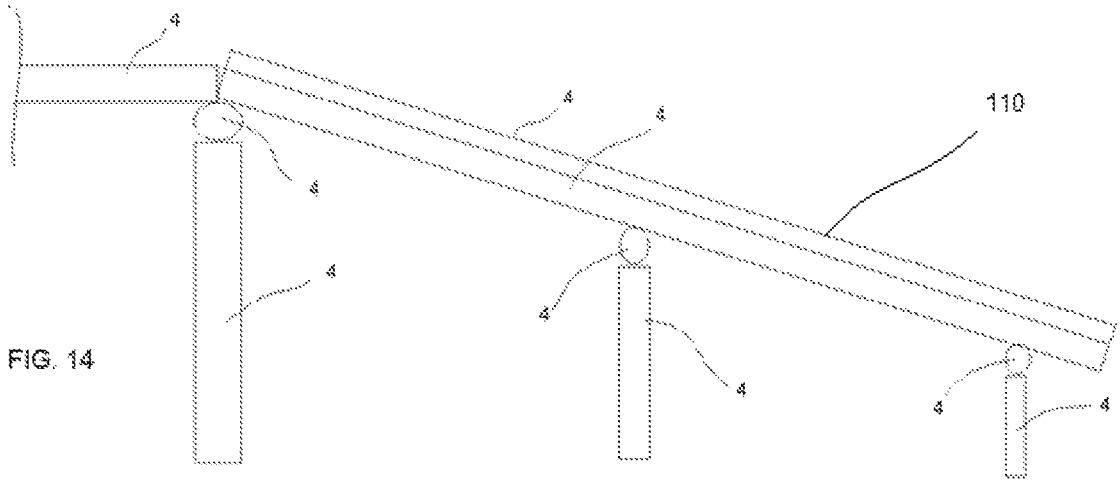
FIG. 14 shows an alternate configuration of an ice slide made in accordance with the present invention.

Turning now to FIG. 14, there is shown a slide 110 made from a plurality of ice logs 4. Because long ice logs can be formed quickly, within a day or two a slide could be formed by building a structure and then placing long ice logs to form the slide surface. Larger ice logs could be used on the sides to prevent the user from falling off the slide. The slide could be added to a balcony, or could simply have a staircase.

Figure 15:
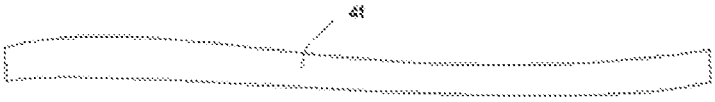
FIG. 15 shows an alternate ice log that could be used to make an ice slide.

FIG. 15 shows an alternate configuration of an ice log 4*t* which could be used for a slide so that the slide has a wave-like surface. This can be done by simply laying of the water filled sleeve so that the sleeve curves. As soon as the water in the sleeve freezes, the ice logs can be used to make a wave shaped slide.

Figure 16:
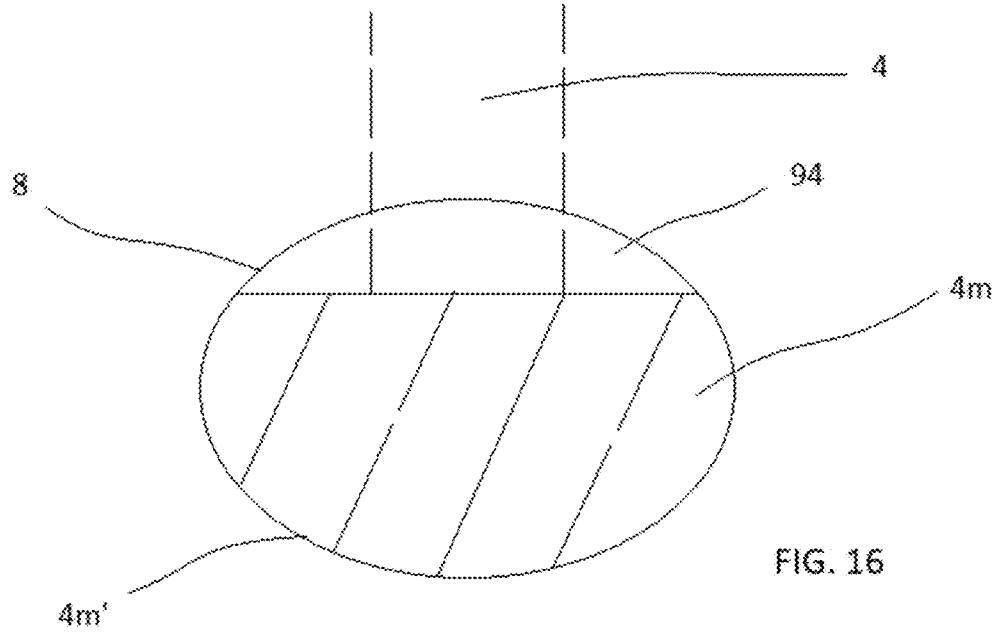
FIG. 16 shows a cross-sectional view of an ice log which is being used as a base.

FIG. 16 shows an alternate construction method. While cutting holes in the ice log 4*m* which forms the base or footing is desirable, it is not necessary. By filling the sleeve 8 only part way with water, the top surface of the ice log 4*m* will be generally flat and an air gap 94 may be left between the top surface of the ice log and the sleeve. When all or a portion of the sleeve 8 is cut way, the flat surface of the ice log 4*m* is available for attaching other ice logs thereto. The flat surface of the ice log 4*m* facilitates a vertical ice log 4 from being disposed on the base/footer formed by ice log 4*m* by simply placing the end of the ice log 4 on the base. If the bottom end of the ice log 4 and the upper surface of the ice log 4*m* are sufficiently flat and of sufficient diameter, the ice log 4 may remain in place without any bracing, support, etc. Water or snow can then be added to freeze the two ice logs together.

It will be appreciated that ice log 4*m* in FIG. 16 has a rounded lower surface 4*m*', unlike the lower surface of the ice log 4*m* shown in FIG. 9. This can be accomplished by forming the ice log on snow, which will give way to the weight of the water, while the ice log 4*m* in FIG. 9 is characteristic of a partially filled sleeve made on solid ground.

Figure 17:
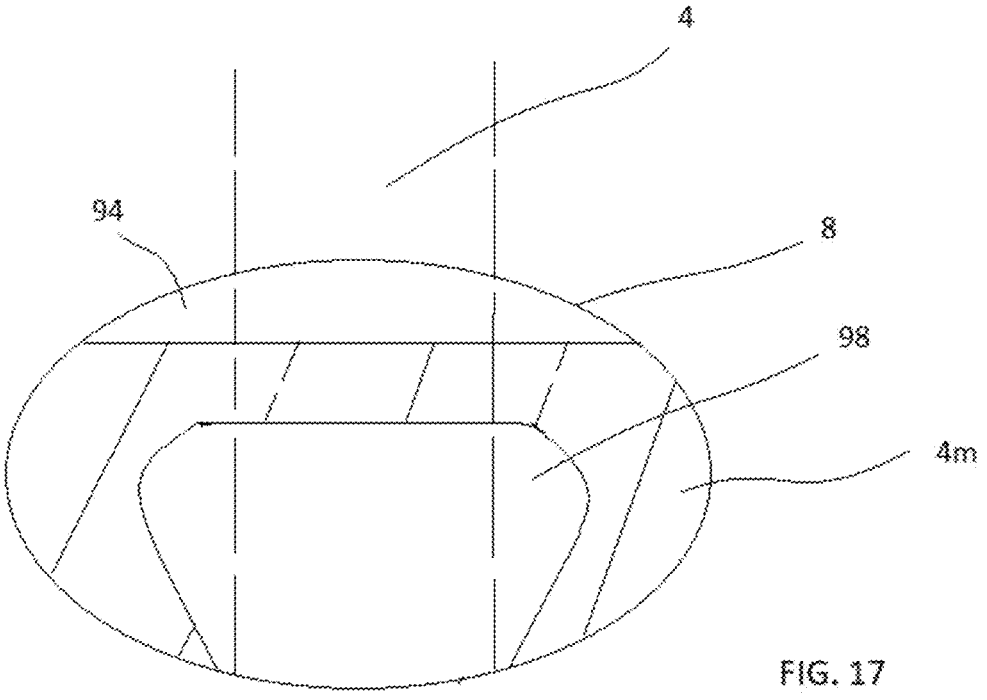
FIG. 17 shows a cross-sectional view of an alternate embodiment of an ice log which is being used as a base.

Turning now to FIG. 17, there is shown an alternate method for attaching ice logs 4 to the ice log 4*m* forming the base/footing. The ice log 4*m* may be allowed to freeze part way so as to leave a pocket of water 98. The sleeve 8 may be partially or completely removed, and a hole cut in the upper surface of the ice log 4*m* sufficient to insert another ice log 4 into the pocket of water 98. If the ice log has not been left long enough that the bottom is frozen, the pocket of water 98 can be drained off by removing the sleeve or puncturing the sleeve if desired. If the lower portion of the sleeve is left in place and not punctured or the bottom of the ice log has frozen solid, the water is then allowed to continue to freeze, thereby anchoring the ice logs in the base/footing. The pocket left by any water which does escape may also be filled in by over-spay. If necessary, vertical ice log 4 may be held while the water continues to freeze. This can be done by external support and/or snow or slush can be packed around the juncture of the two ice logs and allowed to freeze solid.

It will be appreciated that the technique for inserting the logs can be used for a variety of purposes. For example, a ladder of ice could be made by cutting into partially frozen logs and inserting a number of rungs, and then inserting the opposing ends of the rungs into another frozen or partially frozen ice log.

It will be appreciated that inserting an ice log into a pocket in another ice log allows for a substantially stronger juncture than simply applying slush or snow amount at the end and allowing that to freeze. The pocket can provide substantial lateral support, which can prevent an ice log from breaking off of an ice log to which it is attached. This also allows for building at an accelerated rate. For example, depending on ambient temperature, buildings two or more stories tall can be built in a single day. Likewise, this mechanism for inserting facilitates stronger joints and less waste of water, as less ice needs to be added simply to hold the pieces of ice in place.

Figure 18:
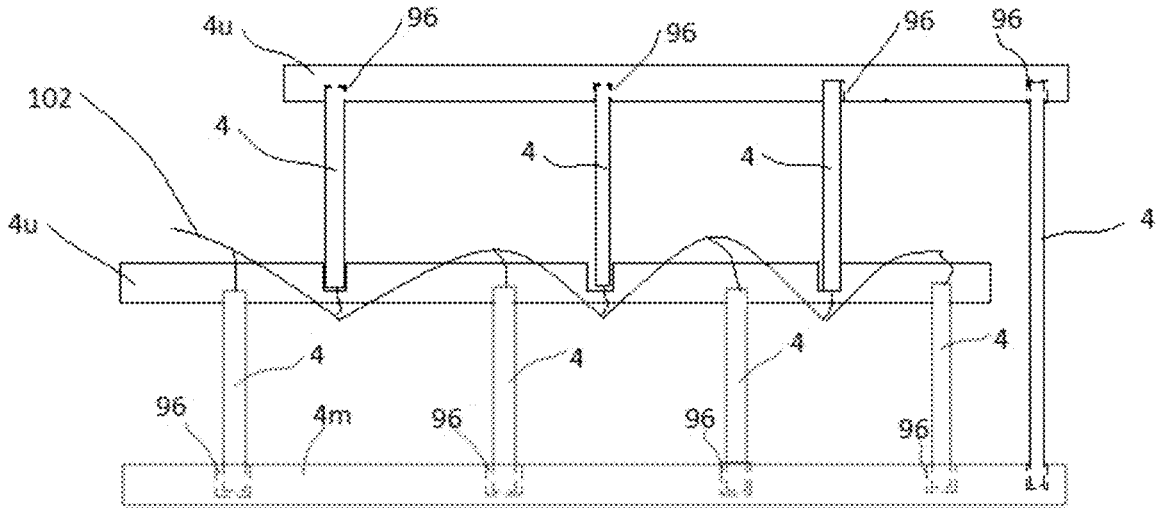
FIG. 18 shows a side view of an ice structure built in accordance with one aspect of the present invention.

Turning now to FIG. 18, there is shown an alternate application of aspects of the present invention. As mentioned previously, the use of ice logs allows for rapid building. Not only can the pockets 96 be formed in the ice log 4*m* forming the base or footing, pockets can also be formed in ice logs 4*u* which form a header. The pockets 96 allow the top end of the vertical (or other orientation) ice logs to be inserted into the ice log 4*u*. (The outlines of the pockets 96 have not been shown in the middle horizontal ice log 4*u* which acts as a base for the top row of vertical ice logs and as a header for the bottom row or vertical ice logs for the sake of clarity but may be present to gain the advantages discussed herein) Inserting the end in a sufficient distance (i.e. 3-4 inches) provides instant stability to the ice log 4*u* on top of the ice logs 4. Preferably the pockets are only slightly larger than the diameter of the vertical ice logs 4 so that the ice logs almost nest in place. Slush or water can be placed in the pockets just before attachment to promote the vertical ice logs and the header ice log 4*u* from freezing together. Additionally, if structure is over-sprayed with water, the freezing water also freezes the various ice logs together. However, the simple engagement of the top of the ice log in the pocket instantly prevents the vertical ice log from simply rolling off and avoid the need for someone to stand there and hold it in place while slush freezes sufficiently to hold the ice logs together.

Because the header ice logs 4*u* are already generally stable when placed on the vertical ice logs 4, the next layer of vertical ice logs can be added much sooner. There is no need to coat the ice logs over night with water to build up sufficient mass to hold the weight of the next level as is done when building with icicles. Additionally, the use of the pockets 96 facilitates the use of powered lines 102. Once the pocket 96 is formed, a drill can be used to form a small hole through to the exterior of the ice log or the powered line can be passed out of a small gap in the pocket 96 between the generally horizontally extending ice logs 4*m*, 4*u* and the vertical ice logs 4. The lower lines 102 can be connected together and then power supplied to, for example, light up multiple ice logs from inside the ice logs. This provides a more brilliant effect than simply backlighting, and ice logs can be made to provide individual colors or combinations of colors. For example, one ice log could light up blue, while the next is green, the next is yellow and the next is purple. Patterns could be formed in the structure by regulating when a given color is being shown in each ice log.

Figure 19:
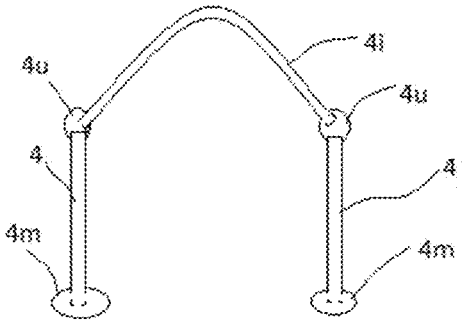
FIG. 19 shown an end view of an ice structure built in accordance with one aspect of the present invention.

While shown in FIG. 18 as relating to vertical ice logs, it will be appreciated that the use of pockets could be done with a variety of different ice log shapes and orientations. For example, instead of vertical ice logs on the second layer, pockets may be used to hold ice logs used for lateral bracing between adjacent vertical or horizontal ice logs. Likewise, a row of semicircular ice logs 4*i* could be used to form a tunnel by attaching to adjacent header ice logs 4*u* as shown in FIG. 19. Furthermore, the structures shown in FIG. 5 could be attached using pockets to facilitate attachment beyond simple surface attachment with a coating of ice.

Thus, there is disclosed a method for creating an ice structure. It will be appreciated that numerous modifications may be made without departing from the scope and spirit of this disclosure. The appended claims are intended to cover such modifications.

What is claimed is:

1. An ice structure comprising:

a base ice log disposed on the ground; and a plurality of upwardly extending ice logs have upper ends and lower ends, wherein the lower ends of the plurality of upwardly extending ice logs are disposed in the base ice log.

2. The ice structure of claim 1, further comprising a plurality of generally horizontal ice logs disposed on top of the plurality of ice logs which extend upwardly.

3. A method of building an ice structure, the method comprising:

disposing a base ice log on a ground surface of soil or snow;

forming a plurality of holes in the base ice log; and disposing a plurality of ice logs in the plurality of holes so that the plurality of ice logs extend upwardly from the base ice log.

4. The method according to claim 3, wherein disposing a base ice log on a ground surface of soil or snow includes selecting an elongate plastic sleeve which has an open first end and an open second end, tying off the open first end and partially filling the elongate plastic sleeve with water.

5. The method according to claim 4 wherein the base ice log has a bottom portion and wherein the elongate plastic sleeve conforms to the ground surface so that a bottom portion of the base ice log conforms to the ground surface as the water freezes.

6. The method according to claim 4, wherein the method comprises keeping some air in the sleeve so that the base ice log has a flat portion on a top of the base ice log.

7. The method according to claim 4 wherein the sleeve is cut away from the base ice log after the base ice log is frozen.

8. The method according to claim 3 wherein the plurality of holes extend through the base ice log.

9. The method of claim 3, wherein the method comprises pouring water into the plurality of holes after the upwardly extending plurality of ice logs have been disposed therein.

10. The method of claim 3, wherein the method comprises disposing slush in the plurality of holes after the upwardly extending plurality of ice logs have been disposed therein.

11. The method of claim 3, wherein the method comprises forming plurality of the holes slightly larger than a cross-sectional area of each of the upwardly extending plurality of ice logs.

12. The method of claim 3, wherein the upwardly extending plurality of ice logs are cut from a single ice log which is 60 feet long.

13. The method of claim 3, wherein the method further comprises disposing horizontal ice logs on two or more ice logs of the upwardly extending plurality of ice logs.

14. The method of claim 13, wherein the method comprises spraying water over the horizontal ice logs to freeze the horizontal ice logs and the on two or more ice logs of the upwardly extending plurality of ice logs together.

15. The method according to claim 3, wherein the plurality of ice logs is formed by cutting an ice log which is 100 feet long in a plurality of shorter ice logs.

16. The method according to claim 3, further comprising at least one horizontal ice log disposed on top of the plurality of ice logs which extend upwardly from the base ice log, and wherein the at least one horizontal ice log has holes formed therein, at least some of the plurality of ice logs extending upwardly from the base ice log being disposed in the holes.

17. The method according to claim 3, wherein the base ice log is formed in an elongate plastic sleeve by laying the elongate plastic sleeve on the ground, tying off one end of the elongate plastic sleeve, partially filing the elongate plastic sleeve with water, tying off the second end of the elongate plastic sleeve and allowing the water in the elongate plastic sleeve to freeze.

18. A method for building an ice structure, the method comprising:

disposing a plurality of ice logs generally vertically;

disposing a first generally horizontal ice log so that the first generally horizontal ice log rests on at least two of the plurality of ice logs;

disposing a second generally horizontal ice log so that it rests on at least two of the plurality of ice logs, the second generally horizontal ice log being spaced apart from the first generally horizontal ice log;

disposing a plurality of ice logs horizontally on top of the first generally horizontal ice log and the second generally horizontal ice logs so that the plurality of ice logs extend between the first generally horizontal ice log and the second generally horizontal ice log, the plurality of ice logs disposed on top of the first generally horizontal ice log and the second generally horizontal ice log being disposed side by side so as to form a balcony above the plurality of ice logs disposed generally vertically;

spraying water onto the ice logs until the first generally horizontal ice log and second generally horizontal ice log freeze to ice logs of the plurality of ice logs disposed generally vertically.

19. The method according to claim 18, further comprising disposing a third generally horizontal ice log on top of ice logs of the plurality of vertical ice logs, the third generally horizontal ice log being spaced apart from the second generally horizontal ice log on a side opposite the first generally horizontal ice log, and wherein the plurality of horizontal ice logs disposed on the first generally horizontal ice log and the second generally horizontal ice log are attached to the third generally horizontal ice log.

20. The method according to claim 18, wherein each of the ice logs is between 4 and 9 inches in diameter so that the balcony will support a plurality of people.

21. The method according to claim 18, further comprising disposing ice logs at an angle between ice logs to provide lateral support.

* * * * *